US012129745B2

(12) United States Patent
Wiik

(10) Patent No.: US 12,129,745 B2
(45) Date of Patent: Oct. 29, 2024

(54) DEEP GAS-LIFT IN COMPROMISED WELLS

(71) Applicant: Weatherford Technology Holdings, LLC, Houston, TX (US)

(72) Inventor: Mads Roland Wiik, Stavanger (NO)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/174,554

(22) Filed: Feb. 24, 2023

(65) Prior Publication Data

US 2024/0287881 A1 Aug. 29, 2024

(51) Int. Cl.
*E21B 43/12* (2006.01)
*E21B 33/124* (2006.01)

(52) U.S. Cl.
CPC ..... *E21B 43/122* (2013.01); *E21B 33/124* (2013.01)

(58) Field of Classification Search
CPC ..... E21B 43/122; E21B 33/124
See application file for complete search history.

(56) References Cited

U.S. PATENT DOCUMENTS

| | | | | |
|---|---|---|---|---|
| 3,224,267 | A * | 12/1965 | Harlan | E21B 43/14 166/313 |
| 4,708,595 | A | 11/1987 | Maloney | |
| 5,022,427 | A | 6/1991 | Churchman et al. | |
| 6,367,555 | B1 * | 4/2002 | Senyard, Sr. | E21B 43/122 166/372 |
| 7,322,410 | B2 * | 1/2008 | Vinegar | E21B 41/0085 166/250.15 |
| 7,770,637 | B2 | 8/2010 | Phoi-montri et al. | |
| 8,006,756 | B2 | 8/2011 | Mazzanti | |
| 9,127,539 | B2 | 9/2015 | Maier et al. | |
| 9,719,311 | B2 | 8/2017 | Tunget | |
| 10,337,296 | B2 * | 7/2019 | Scull | E21B 43/122 |
| 10,563,488 | B2 | 2/2020 | Molstre | |
| 10,858,921 | B1 * | 12/2020 | Juenke | E21B 43/123 |
| 10,883,350 | B2 | 1/2021 | Shen et al. | |
| 10,890,057 | B2 | 1/2021 | MacPhail et al. | |
| 10,982,514 | B2 | 4/2021 | Archa et al. | |
| 11,359,469 | B2 | 6/2022 | Archa | |
| 2003/0024704 | A1 | 2/2003 | Hirsch | |
| 2005/0252689 | A1 | 11/2005 | Gardes | |
| 2015/0060077 | A1 | 3/2015 | Vetter et al. | |
| 2017/0226831 | A1 * | 8/2017 | Lugtmeier | E21B 43/122 |
| 2017/0356267 | A1 * | 12/2017 | Hazel | E21B 33/126 |
| 2019/0178048 | A1 * | 6/2019 | Krüger | E21B 33/126 |
| 2022/0397023 | A1 | 12/2022 | Enerstvedt et al. | |

FOREIGN PATENT DOCUMENTS

| | | |
|---|---|---|
| CN | 209195382 | 8/2019 |
| CN | 108252685 B | 9/2020 |
| CN | 114135253 A | 3/2022 |

OTHER PUBLICATIONS

International Search Report and Written Opinion of the ISA, PCT/US2023/075644, dated Jan. 16, 2024, 15 pages.

* cited by examiner

*Primary Examiner* — Taras P Bemko
(74) *Attorney, Agent, or Firm* — Peter V. Schroeder; Booth Albanesi Schroeder PLLC

(57) ABSTRACT

A completion string for running gas-lift operations in a hydrocarbon well has a bypass string with a central bore for flowing production fluids to the surface and an annular passageway for flowing gas-lift gas downwards to a gas-lift assembly in the wellbore.

14 Claims, 7 Drawing Sheets

DEEP GAS-LIFT IN COMPROMISED WELLS

CROSS-REFERENCE TO RELATED APPLICATIONS

None.

TECHNICAL FIELD

The present disclosure relates to gas-lift operations in oil and gas wells, and more particularly, to apparatus and methods for performing gas-lift operations in a wellbore wherein a portion of the wellbore is compromised and not unable to contain gas for a gas-lift operation.

BACKGROUND

A wellbore is formed using a drill string to create a wellbore through a geological formation to or through one or more target production zones bearing recoverable hydrocarbons. After drilling through the formation to a predetermined length or depth, the drill string is removed. It is typical to drill multilateral wells, that is, in a single well, two or more wellbores which diverge and extend separately into the formation. The lateral wellbores can be vertical or horizontal wellbores. Often, casing is positioned from the wellhead to a desired depth and cemented in place. Below the casing, in closed-hole wells, a liner or string of liners may be hung from the casing and extend to a greater depth in the wellbore. The liners may be cemented in place, by cementing the annulus between the liner and the formation, or simply hung into an open bore portion of the well.

Once the well is drilled, various operations may be carried out to prepare the well for production, such as perforating casing or liners, hydraulic fracturing, chemical injections, installation of screens, gravel packs, and the like, as are known in the art. Some of these operations can occur intermittently, both before and between periods of production of hydrocarbons from the well. To produce hydrocarbons, a completion string, or production tubing, is run into the wellbore to convey production fluid (e.g., hydrocarbon-bearing fluids) from the target zone to the surface. A completion string is made up of multiple tubular sections, or tubing, which are connected, typically by threaded connections, at joints. The completion string can also include various downhole tools, such as packers for sealing the annulus between the production tubing and the casing or wellbore, pressure and temperature gauges, control valves, safety valves, side pocket mandrels, various plugs, etc.

Often, pressure within the formation is insufficient to cause production fluid to easily rise through the production tubing to the surface. To assist the production fluid in flowing to the surface, artificial lift is sometimes necessary. More particularly, artificial gas-lift systems are often preferred, especially under certain conditions. Generally, gas-lift operations inject gas into the production tubing to reduce the density of the fluids in the tubing, thereby lowering the bottomhole pressure at the bottom of the tubing and allowing the production fluid to flow to the surface. Typically, the injection gas is from an outside source, compressed, and pumped down the annulus adjacent the production tubing, then into the production tubing through gas-lift valves positioned above the production zone.

Gas-lift systems rely on gas-lift valves, which are typically internal, one-way valves spaced along an annulus in the production tubular. The gas-lift valves allow the pressurized gas, flowing down the annulus, into the production bore where the gas acts to reduce the density of the production fluid above the production zone, assisting in lifting the production fluid. The gas-lift valves are one-way valves, not allowing fluid flow from the production bore into the lift gas supply annulus.

The two primary types of gas-lift system are tubing-retrievable and wireline-retrievable gas-lift systems. When tubing-retrievable gas-lift systems are utilized, the entire production tubing string must be retrieved from the wellbore to access the gas-lift valves for repair, replacement, or changing pressure settings, because the production tubing and gas-lift valves are integral. Wireline-retrievable gas-lift systems permit retrieval of the gas-lift valves using a wireline without necessitating the removal of the production tubing or killing the well. Removing the entire production tubing from the wellbore is costly and inefficient; therefore, wireline-retrievable gas-lift systems are often preferred, especially when the gas-lift system is offshore or in remote locations.

BRIEF DESCRIPTION OF THE DRAWINGS

Drawings of the preferred embodiments of the present disclosure are attached hereto so that the embodiments of the present disclosure may be better and more fully understood.

DETAILED DESCRIPTION OF EMBODIMENTS

The exemplary well systems depicted and discussed herein are shown as generally vertical or slightly deviated. It is understood, however, that the wellbores can be lateral, horizontal, vertical, deviated, etc. Hence, terms such as "uphole, "downhole," "upwards," "downwards," and the like, which are literally accurate in a vertical well, are used to also refer to non-vertical wellbores where "up" generally denotes in the direction of or closer to the wellhead, while "down" generally denotes in the direction of or closer to the bottom or toe of the wellbore.

Wellbore System

Figure 1:
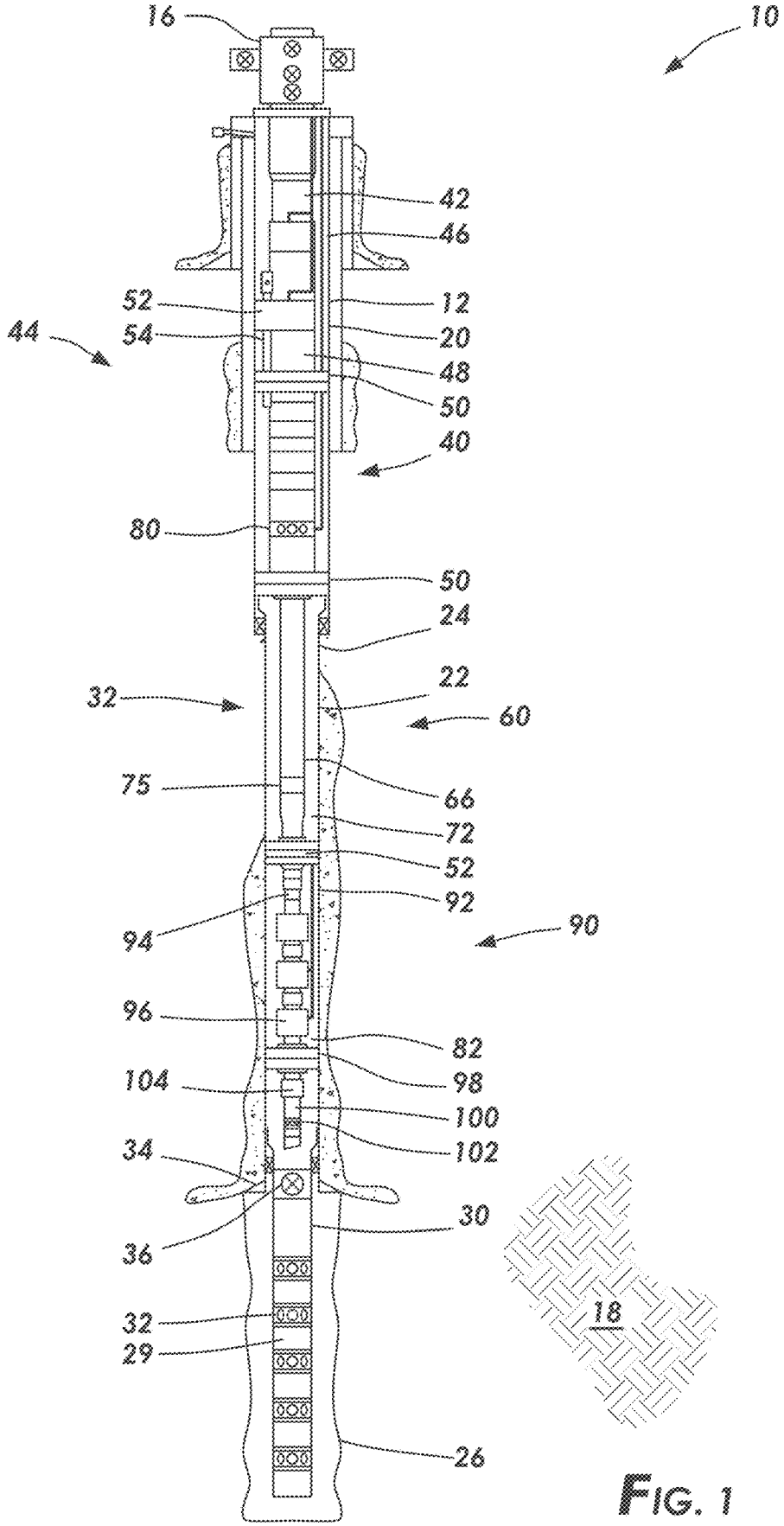
FIG. 1 is a schematic elevational view, in partial cross-section, of an exemplary wellbore system having a production or completion string extending through a wellbore according to aspects of the disclosure.

FIG. 1 is a schematic elevational view, in partial cross-section, of an exemplary wellbore system 10 having a production or completion string extending through a wellbore according to aspects of the disclosure. A wellbore 12 extends from a wellhead 14 having appropriate surface equipment 16, such as a Christmas tree or rig assembly. The wellbore 12 extends through a subterranean formation to a target production zone 18. The wellbore 12 is typically cased along at least a portion of its length, having a casing 20 cemented in place. Further, portions of the wellbore 12 may have liners 22 installed. A liner 22 can be hung from the casing 20 at a liner hanger 24, for instance. Multiple liners or other tubulars may be used to isolate the wellbore from the surrounding formation. The casing and/or liners may be pre-perforated, prior to installation, or perforated in place using perforation equipment lowered into the well on a perforation work string. Portions of the wellbore 12 may also be open bore 26, that is, not lined with casing or a liner.

The exemplary well shown has an open bore 26 at its lower end adjacent the production zone. A liner assembly 30, having a series of screens 38, hangs from a liner hanger 34 and extends into the open bore portion of the well adjacent the target production zone 18. An isolation valve 36 is positioned to control the flow of fluid through a central bore 29 of the liner assembly 30. Persons of skill in the art will recognize that the wellbore can be cased, lined, or open bore at various points, including adjacent the production zone. Further, a lined or open bore can be gravel packed and the like.

Compromised Section

Figure 4:
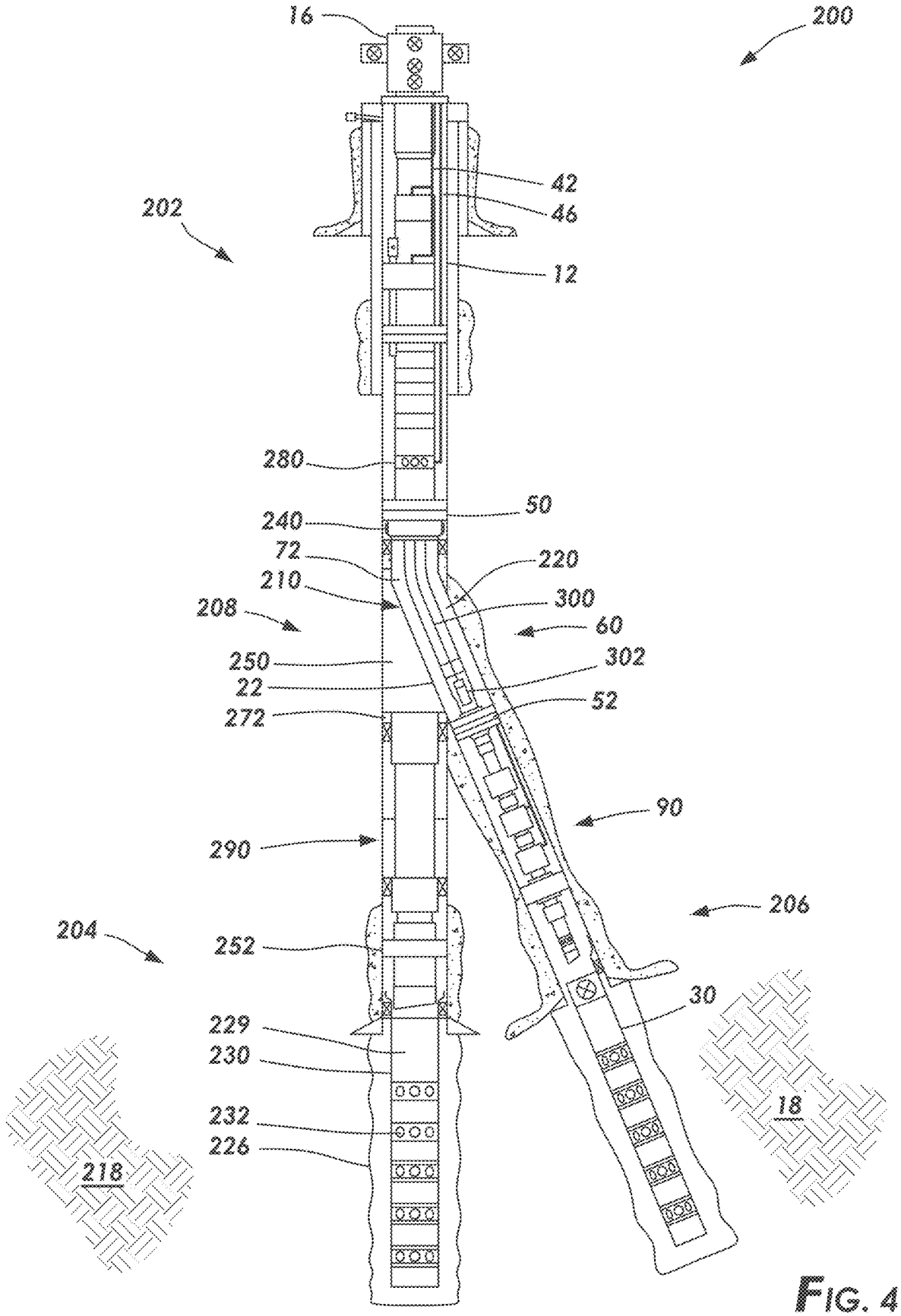
FIG. 4 is a schematic elevational view, in partial cross-section, of an exemplary wellbore system having a completion string extending through a lateral wellbore and a completion string extending through a main wellbore, according to aspects of the disclosure.

The disclosure provides solutions for providing gas-lift operations in wellbore below a compromised section of the wellbore. As used herein, "compromised section" refers to a portion or length of a wellbore which cannot or should not be used to convey gas-lift gas downhole. The compromised section is incapable of carrying the gas-lift gas, or doing so safely or efficiently, due to a problem or structural issue with the wellbore. For example, a cased or lined section of the wellbore may not be pressure rated for carrying high-pressure gas-lift gas. Alternately, a cased or lined section may have damage, such as tears or accidental holes in the casing or liner. Further, a perforated casing or liner is considered a compromised section for gas-lift purposes. In other embodiments, the compromised section may be a junction with an additional wellbore, such as in a multilateral well. Turning briefly to FIG. 4 the secondary wellbore 206 is a candidate for gas-lift operations. However, since the junction 208 between the secondary wellbore 206 and the main bore 204 is open to fluid flow, it is not possible to effectively flow gas-lift gas from the surface, along the wellbore annulus, past the bore junction and down to the foot of the secondary wellbore. If attempted, the gas-lift gas would dissipate into the additional main bore 204 and possibly into the formation adjacent the compromised section. The junction 208 may be open or bridged by a perforated tubular, as shown, which allows fluid flow from or into the main bore. While it would be possible to shut down or plug the main bore 204 for the duration of the gas-lift operation in the secondary wellbore, this obviously severely limits production capacity from the well as the main bore could not be simultaneously produced. The disclosure presents a solution to this problem.

Completion String Assembly

Upper String Assembly

Turning back to FIG. 1, a completion string assembly 40 for use in a gas-lift operation extends through the wellbore 12 and along a compromised section 32 of the wellbore. The compromised section 32 is not capable of carrying gas-lift gas along the wellbore anulus, as discussed above. The completion string assembly 40 comprises tubular members and wellbore tools joined together, as is known in the art, to create the string. Upper completion string assembly 42 extends along an upper wellbore 44 above the compromised section 32. The upper string assembly 40 runs from the wellhead 14 to upper annular packer 50, which seals against the casing 20 to effectively seal off upper wellbore annulus 46. The upper string assembly 40 defines a central bore 48 which extends longitudinally through the upper string assembly. The central bore 48, during the gas-lift operation, carries production fluid from the production zone, mixed with gas-lift gas, upwards to the surface. Gas-lift gas is pumped down the upper wellbore annulus 46.

The upper completion string assembly 42 can include additional tools, valves, safety equipment, control lines, and the like, as those of skill in the art will understand. For example, the upper string 42 has a safety packer 50, or annular safety valve, positioned to seal the upper wellbore annulus to prevent unplanned gas release during gas-lift operations. A control module 52 and gas-lift bypass 54 are used to push gas-lift gas downwards, past the safety packer 50 along the upper wellbore annulus 46.

Bypass String Assembly

Figure 2:
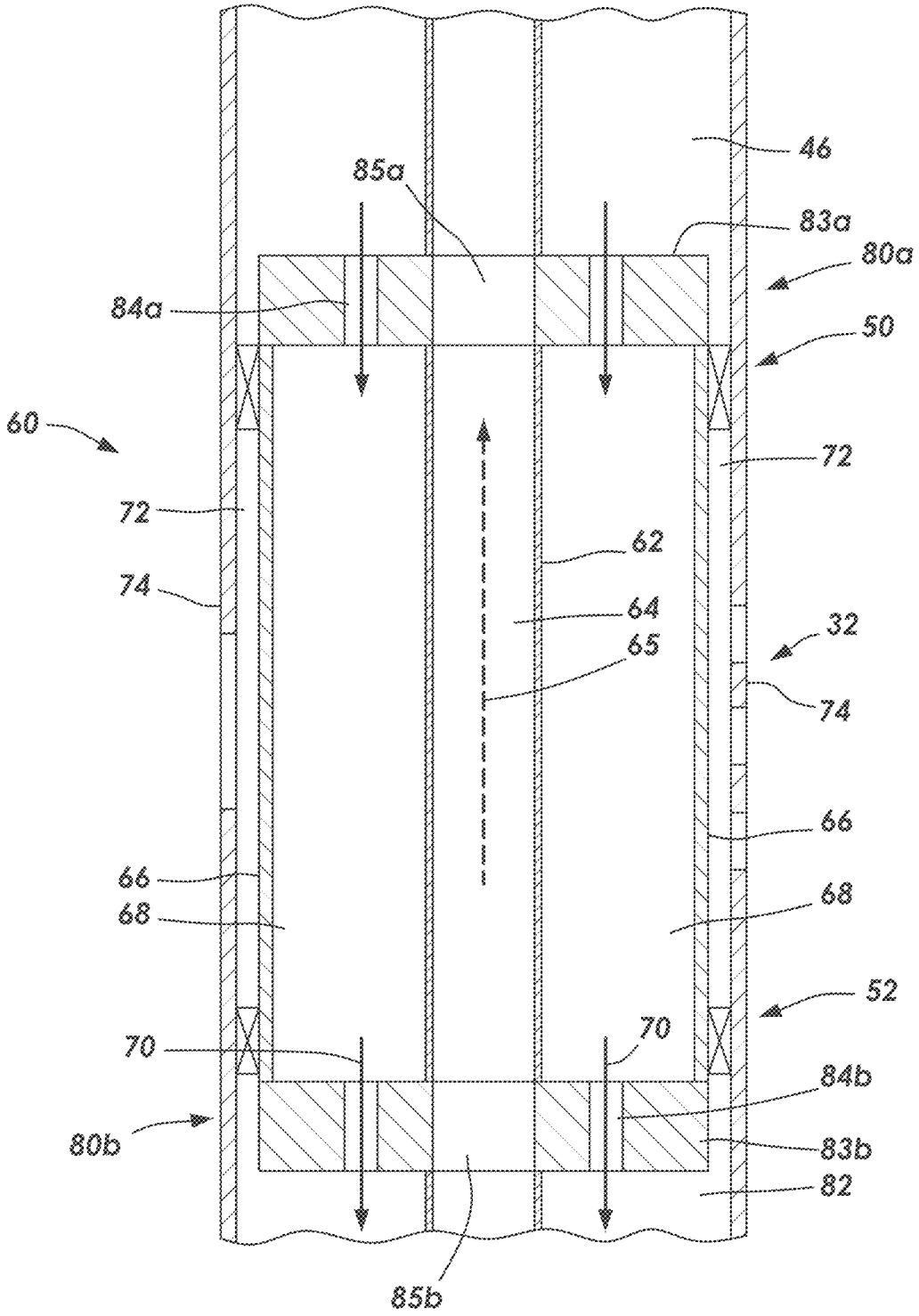
FIG. 2 is a schematic elevational view of an exemplary bypass string assembly according to aspects of the disclosure.

A bypass string assembly 60 is positioned in and extends through the compromised section 32 of the wellbore. FIG. 2 is a schematic elevational view of an exemplary bypass string assembly according to aspects of the disclosure and is discussed along with FIG. 1. An upper annular packer 50 and a lower annular packer 52 isolate the central wellbore annulus 72, sealing against the liner 22. The bypass string assembly 60 extends through the upper packer 50, along the compromised section 32, and through the lower packer 52. The bypass string assembly has a central tubular 62 defining a central bore 64 extending longitudinally through the central tubular. The central bore 64 fluidly communicates with the central bore 48 of the upper string assembly 42, allowing production fluid, mixed with gas-lift gas, to flow upwards towards the surface, as indicated by arrow 65. The central tubular 62 is positioned in a gas-lift tubular 66. A gas-lift annulus 68 is defined between the central tubular 62 and the gas-lift tubular 66. The gas-lift annulus 68 allows gas-lift gas to flow downwards, past the compromised section 32 of the wellbore, as indicated by the arrows 70. The gas-lift gas is contained in the gas-lift annulus 68 and does not enter or flow through the central wellbore annulus 72 defined between the gas-lift tubular 66 and the wellbore 12, here lined by compromised liner 74.

Figure 3:
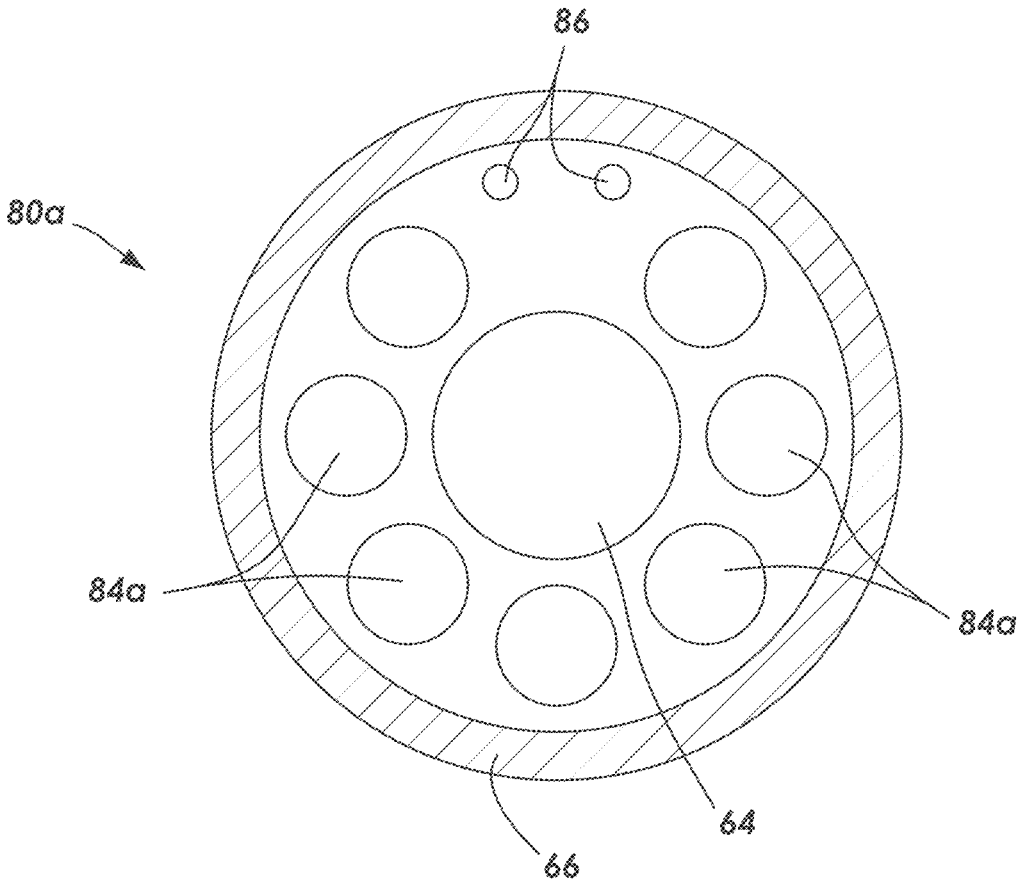
FIG. 3 is a cross-sectional schematic view of the exemplary upper ported device 80*a* of FIG. 2, according to aspects of the disclosure.

A ported device 80 is positioned at the upper end of the bypass string assembly. FIG. 2 shows an embodiment of an upper and a lower annular ported device **80*a* and 80*b*, respectively. FIG. 3 is a cross-sectional schematic view of the exemplary upper ported device 80*a* of FIG. 2, according to aspects of the disclosure. The upper ported device 80*a* has a housing 83*a* connected to the central tubular 62, along the circumference thereof, and extending across the upper end of the gas-lift annular passageway 68. The ported device 80*a* defines a plurality of longitudinally extending gas-lift ports 84*a* fluidly connecting the gas-lift annulus 68 with the upper wellbore annulus 46. In an alternate embodiment, see in FIG. 1, the gas-lift ports 84*a* can exit the housing radially. In some embodiments, the ported device 80*a* also defines a central bore 85*a* therethrough in fluid communication with the central bore 64** below.

Similarly, the lower ported device **80*b* has a housing 83*b* connected to the central tubular 62, along the circumference thereof, and extending across the lower end of the gas-lift annular passageway 68. The lower ported device 80*b* defines a plurality of longitudinally extending gas-lift ports 84*b* fluidly connecting the gas-lift annulus 68 with the lower wellbore annulus 82 below lower packer 52. Thus gas-lift gas can flow from the upper wellbore annulus 46 to the lower wellbore annulus 82 via the gas-lift annular passageway 68, bypassing the central wellbore annulus 72 along the compromised section 32 of the wellbore. The ported device 80***a* can also include control line passageways 86 and the like. In some embodiments, the ported device 80*b* also defines a central bore 85*b* therethrough in fluid communication with the central bore 64 above.

The bypass string assembly 60 can also include other items for assembly, disassembly, attachment of control lines, and the like, as are known in the art. For example, the central tubular 62 can be made up of several tubulars attached together, such as by threaded attachments, as is known in the art. Seen in FIG. 1, for example, is a tubing nipple 75 positioned in the bypass completion string assembly for purposes of running one or more control lines. In an embodiment, one or more control lines 86 (not seen in FIG. 1) run downhole exterior to the bypass string, attach to and run radially through the nipple 75 and then longitudinally through the gas-lift annulus 68. In such an embodiment, the nipple 75 simply forms a portion of the bypass string assembly passing produced fluid through a central bore aligned with the central bore of the bypass string and passing gas-lift gas through annular passageways aligned with the gas-lift annulus.

Lower String Assembly

The completion string assembly 40 can further include a lower string assembly 90 positioned in the wellbore below the lower annular packer 52, a lower wellbore annulus 82 defined between the lower string assembly 90 the wellbore 12, here with a liner 92. The lower string assembly 90 has a central bore 94 for fluidly communicating fluid to the bypass central bore 64. The lower string assembly 90 includes a gas-lift injection assembly 96 for allowing gas-lift gas to flow from the lower wellbore annulus 82 into the central bore 94 of the lower string assembly 90. The gas-lift injection assembly 96 is typically one or more gas-lift valves, as are known in the art and commercially available. The gas-lift injection assembly can also comprise one or more one-way valves, check valves, sliding sleeve valves, rupturable membranes temporarily blocking flow ports, and the like as is known in the art. The lower string assembly can also include pressure and temperature gauges, control modules for operating the gas-lift injection assembly, control lines, chemical injection modules, side-pocket mandrels, and the like.

In practice, the gas-lift gas flows through the gas-lift injection assembly and into the central bore 94 of the lower string assembly 90 where it mixes with production fluid moving upwards from the production zone below.

A production zone annular packer 98 for isolating the lower wellbore annulus 82 is positioned in the wellbore and seals against the wellbore, here a liner. The production zone annular packer 98 is positioned below the gas-lift injection assembly 96.

Production Zone String

Here, a production zone tubular 100 extends through and below the production zone packer 98 and has ports 102 for allowing production fluid into its central bore 104, which fluidly communicates with the central bore 94 of the lower completion string assembly 90.

Method of Use of Single Bore System

In use, a method of performing a gas-lift operation in a wellbore extending through a subterranean formation having a production zone is provided, where the wellbore has a compromised section incapable of carrying gas-lift gas.

Gas-lift gas is pumped from a gas-lift gas source and into the wellbore 12 at the wellhead 16. The gas-lift gas is pumped into and down the upper annulus 42. Where an annular safety packer 50 is present, the gas-lift gas is flowed through a gas-lift bypass 54, past the safety packer 50 and along the upper wellbore annulus 46 below the safety packer. The gas-lift gas is prevented from flowing in the wellbore annulus past the upper annular packer 50.

The gas-lift gas then is flowed through a bypass string assembly 60. Gas-lift gas is flowed into and through a ported device 80*a*, for example, by way of radial and/or longitudinal gas-lift ports 84*a* defined in the ported device. The ported device 80*a* is positioned above the upper annular packer 50. Gas-lift gas is fluidly communicated from the ported device 80*a* into the gas-lift annulus 68, past the upper packer 50, past the compromised section 32 of the wellbore, past the lower annular packer 52, and out the lower end of the gas-lift annulus. If present, the gas-lift gas is flowed through a lower ported device 80*b* via ports 84*b*.

The gas-lift gas is then flowed into the lower wellbore annulus 82. The gas-lift gas is flowed through the gas-lift injection assembly 96 and into the central bore 94 of the lower completion string assembly 90.

Production fluid from the production zone 18 flows into the open bore 26, through screen assemblies 32 on the liner assembly 30, past isolation valve 36 and into the wellbore annulus surrounding the production zone tubular 100. The production zone fluid enters ports 102 and flows upwards into and through the central bore 104 of the production zone tubular, past the production packer 98 and into the central bore 94 of the lower string assembly 94. Here, the production fluid mixes with the gas-lift gas.

The mixture (of gas-lift gas and production fluid) then flows upwards through the central bore 94 of the lower string assembly, into and through the central bore 64 of the bypass string assembly 60, past the lower annular packer 52, past the compromised section 32 of the wellbore, past the upper annular packer 50, through the central bore 85*a* of the ported device and into and through the central bore 48 of the upper completion string assembly 40 to the wellhead 16.

Multilateral System

FIG. 4 is a schematic elevational view, in partial cross-section, of an exemplary multilateral wellbore system having a completion string extending through a secondary wellbore and a completion string extending through a main wellbore, according to aspects of the disclosure.

For purposes of a description of FIG. 4, the multilateral wellbore system 200 has an upper wellbore 202, a main wellbore 204 and a secondary wellbore 206. The main and secondary wellbores are both production wellbores, as both produce hydrocarbons. The terms main and secondary do not necessarily refer to the order of drilling, the relative size, or the production volumes of the wellbores.

FIG. 4 is similar to FIG. 1, described above, with respect to the upper completion string assembly 42, the bypass string assembly 60, lower string assembly 90, production zone tubular 100 and liner assembly 30. These elements and their constituent parts will not be discussed further with respect to FIG. 4, except to point out necessary distinctions.

The main wellbore 204 and the secondary wellbore 206 cross, or meet, at a junction 208. This junction 208 creates a compromised section 210 of the wellbore system. A liner 22 extends from above the junction to below the junction in the secondary wellbore 206. The liner 22 is perforated or otherwise allows fluid flow through the liner wall. Here, production fluid from the main wellbore 202 flows upwards through the perforated liner 22 and into the liner annulus 172 surrounding the bypass string assembly 60 defined between the liner 22 and the bypass string assembly gas-lift tubular 66. That is, the bypass string assembly 60 here bypasses the compromised section in the form of a junction with the main bore 204.

The main wellbore 204 extends through the formation into a main production zone 218. Hydrocarbons flow from the main production zone 218, into the open wellbore section 226, through the screens 232 of the liner assembly 230 and into a central bore 229 of the liner assembly 230. Production fluid from the main bore flows upward through the main bore completion string 290, past various annular packers 252, past the whip-stock 250, and the like, and eventually into the main wellbore annulus 272 just below the junction 208. In some embodiments, the whip-stock 250 has longitudinal bores therethrough to allow main bore production fluid to flow upwards through, and past, the whip-stock. The production fluid from the main wellbore then flows through the perforated liner 22 and into the central annulus 72 surrounding the bypass string assembly 60.

An upper portion of the gas-lift tubular 66 of the bypass string assembly 60 is positioned in an outer production tubular 240. An outer production annular passageway 242 is defined between the outer production tubular 240 and the gas-lift tubular 66. The outer production tubular extends through the upper annular packer 50 and up to the ported device 280. The outer production tubular 240 can be a landing shoe or the like for landing in a polished bore receptacle, in some embodiments. Production fluid from the main wellbore flows upwards through the outer production annular passageway 242, into and through the ported device 280. The main bore production fluid flows through the ported device 280 and into the central bore 48 of the upper string assembly 42 where it is mixed with the mixture of gas-lift gas and production fluid from the secondary wellbore.

Figure 5A:
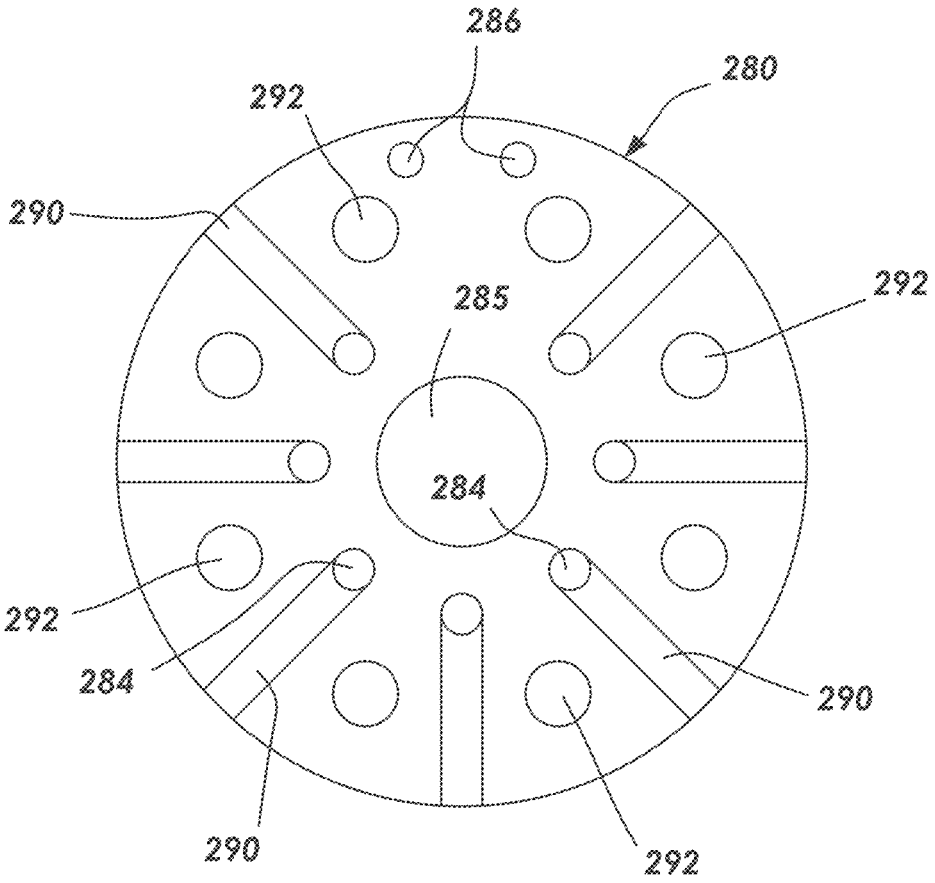
FIG. 5A is a cross-sectional top view of an exemplary ported device 280 according to aspects of the disclosure.
Figure 5B:
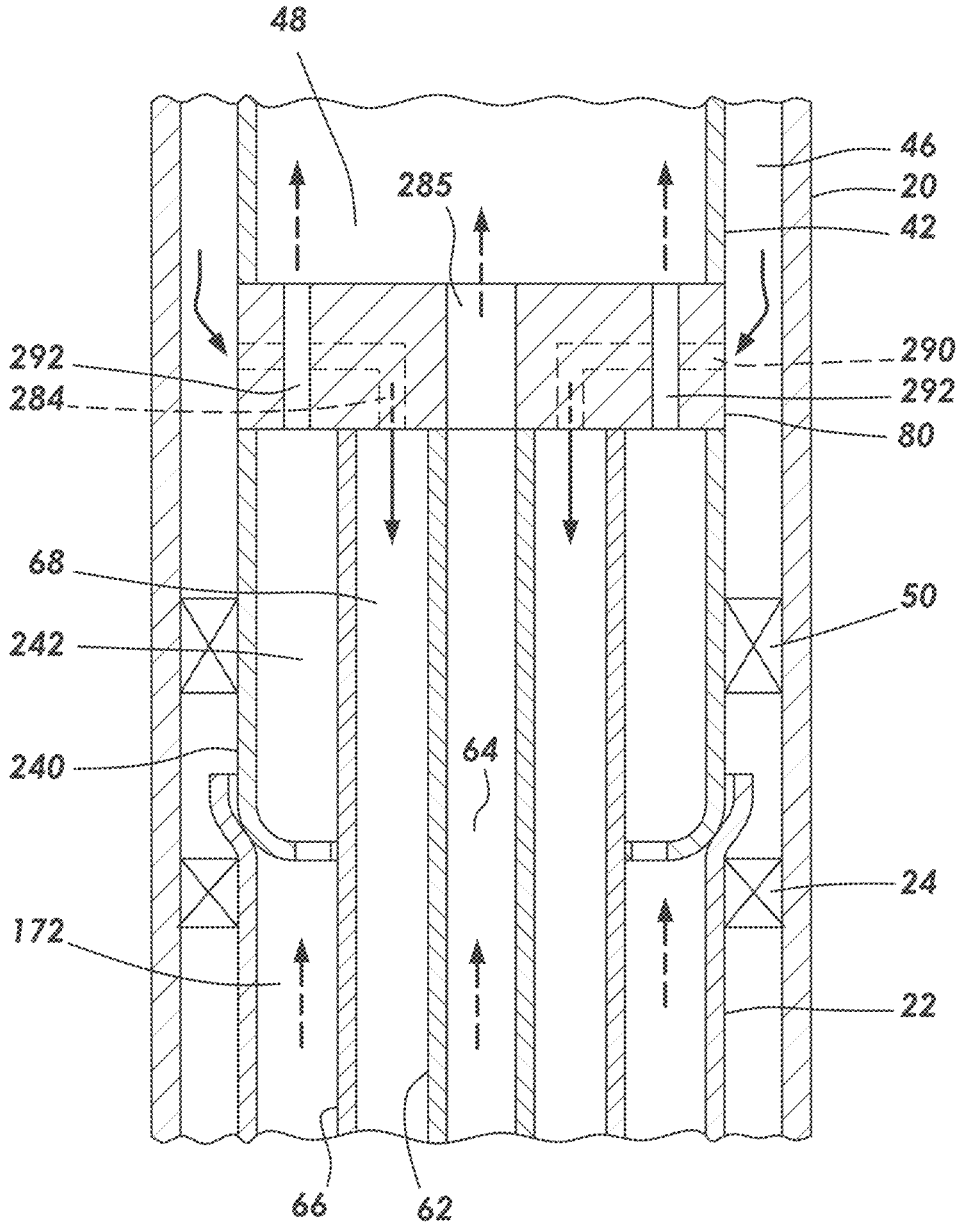
FIG. 5B is a cross-sectional elevational view of the exemplary ported device 280 of FIG. 5A according to aspects of the disclosure.

FIG. 5A is a cross-sectional view of an exemplary ported device 280 according to aspects of the disclosure. FIG. 5B is a cross-sectional elevational view of the exemplary ported device 280 of FIG. 5A according to aspects of the disclosure. The ported device 280 has a central longitudinal bore 285 which aligns with and fluidly communicates with the central bore 64 of the bypass string assembly, and through which a mixture of production fluid from the secondary bore and gas-lift gas flow. The ported device 280 defines a plurality of longitudinal gas-lift ports 284 which fluidly communicate, at their downhole ends, with the gas-lift annulus 68 of the bypass string assembly. Each of the plurality of longitudinal gas-lift ports 284 fluidly communicates with a corresponding radial gas-lift port 290 which radially exits the ported device 280 and fluidly communicates with the upper wellbore annulus 46. The ported device 280 also defines a plurality of longitudinal outer production ports 292 which fluidly communicate with the outer production annular passageway 242 and through which flows production fluid form the main wellbore. The central longitudinal bore 285 and the plurality of longitudinal outer production ports 292 fluidly communicate, at their upper ends, with the central bore 48 of the upper string assembly 42. The production fluid from the main bore mixes with the mixture of gas-lift gas and production fluid from the secondary wellbore in the central bore 48 of the upper string assembly. The ported device 280 can further incorporate control line passageways 286.

In use, the bypass string assembly 60 allows simultaneous production from the secondary wellbore and the main wellbore. As described above with reference to FIG. 1, production fluid from the secondary wellbore flows upwards through the central bores of the production zone tubular 100, the lower completion string assembly 90 (where it mixes with gas-lift gas), the bypass string assembly 60 and upper string assembly 42, where it mixes with production fluid from the main wellbore. Production fluid from the main wellbore 204 flows upwards through the central bores of the liner assembly 230, the completion string assembly 290, into the wellbore annulus 272, through the perforated or slotted liner 22, and into the bore 220 of the liner 22. The main bore production fluid then flows through the outer production annular passageway 242, into and through the ported device 280 and into the central bore 48 of the upper string assembly 42 to the wellhead 16.

Wireline Usage

With further reference to FIG. 4, the apparatus and systems herein allow the use of wireline or coiled tubing for downhole operations in the completion string without any further intervention in the wellbore. Since the central bores of the upper, bypass, lower and production zone assemblies are all aligned and of sufficient diameter, a wireline or coiled tubing assembly can be run into the completion string. An exemplary wireline 300 and wireline tool assembly 302 are shown in FIG. 4. For example, wireline or coiled tubing operations can be run including acid fracturing operations, hydraulic fracturing operations, retrieval and placement of gas-lift valves, opening or operating sliding sleeves and the like downhole, and cleaning screen assemblies in the production zone. The disclosure supports maintaining wireline and/or coiled tubing access into the lower string assembly without requiring an intervention operation in the wellbore.

Tool Make-Up

Figure 6:
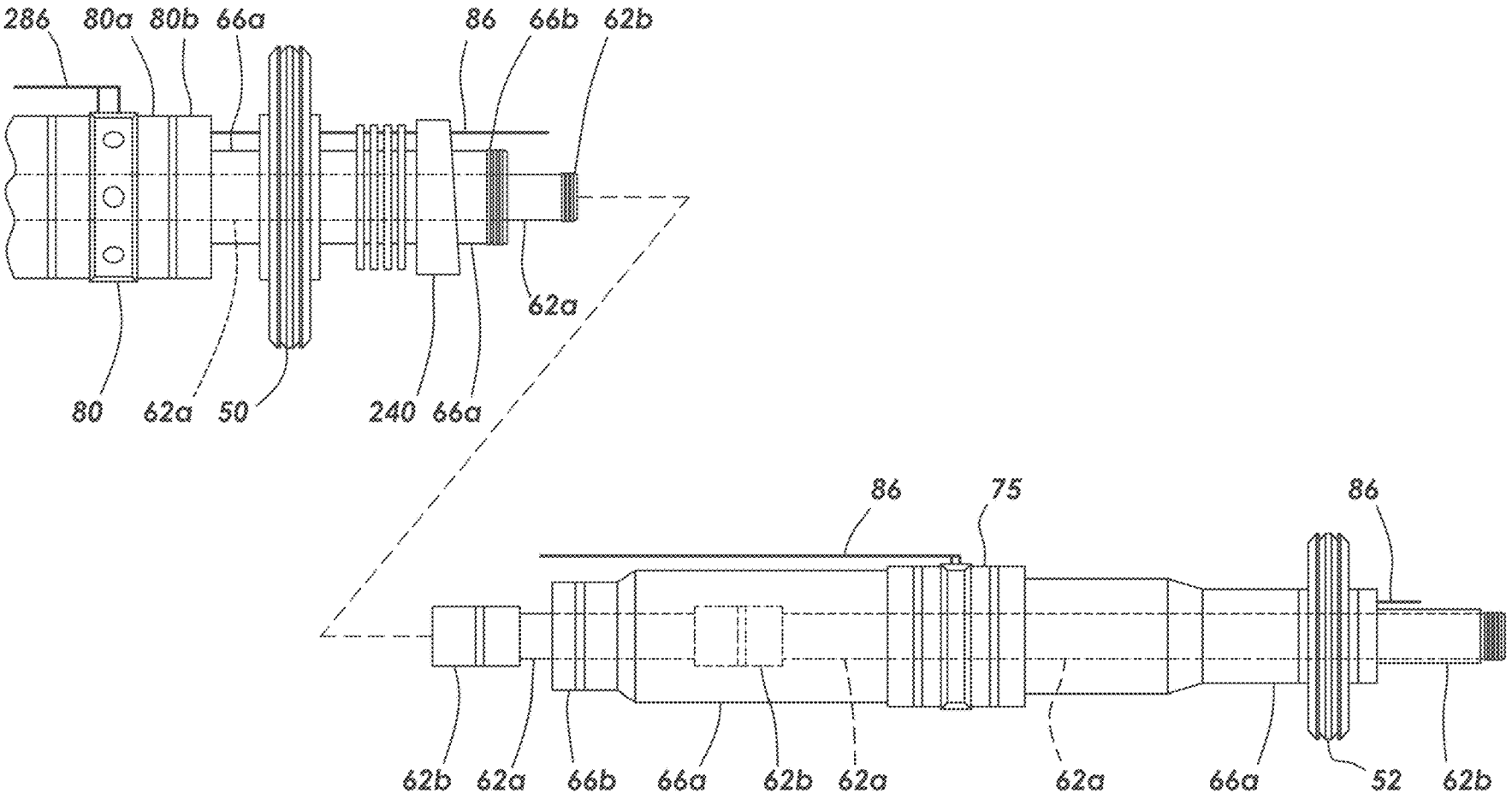
FIG. 6 is a schematic elevational view of an exemplary bypass string assembly according to aspects of the disclosure.

FIG. 6 is a schematic elevational view of an exemplary bypass string assembly according to aspects of the disclosure. In some wellbores, the compromised section 32 may extend over too great a distance for the bypass string assembly 60 to be made-up as a single tool. In such cases, it is necessary to make-up the bypass string at the well site. FIG. 6 shows an upper tool assembly 400 and a lower tool assembly 402. The lower tool assembly 402 includes several lower central tubulars 62*a* which are made-up to one another at joints 62*b*, for example threaded joints. The lower tool assembly 402 has multiple lower gas-lift tubulars 66*a* which can also be joined to one another at joints 66*b*, such as threaded joints. The lower tool assembly 402 also includes the lower annular packer 52 made-up to a gas-lift tubular 66*a*. The lower tool assembly 402 can include a tubing nipple 75. The nipple 75 can be made-up into gas-lift tubulars 66*a* both above and below the nipple 75, and into central tubulars 62*a* both above and below the nipple. In such an embodiment, the nipple 75 simply forms a portion of the bypass string assembly, defining portions of the gas-lift annulus and the central production bore. One or more control lines 86 run along exterior to the bypass string, attach to and run radially through the nipple 75, and then run longitudinally through the gas-lift annulus 68. The control lines are the available to be spliced to lines and tools lower in the completion string.

The upper tool, assembly 400 seen in FIG. 6 is more particularly for use in conjunction with the completion string seen in FIG. 4, wherein production fluid is produced from both a main bore and a secondary bore. Similar to the lower tool assembly, the upper tool assembly 400 can have multiple upper central tubulars 62*a* joined together at joints 62*b*, and multiple gas-lift tubulars 66*a* joined at joints 66*b*. The upper tool assembly 400 includes outer production tubular 240 which extends through the upper packer 50 and to the ported device 280. The outer production tubular 240 can be a landing shoe or the like for landing in a polished bore receptacle. The upper tool assembly 402 also includes the upper annular packer 52 through which extend a gas-lift tubular 66*a*, a central tubular 62*a*, and outer production tubular 240. The ported device 80 is made up, for example at multiple threaded joints, to the central tubular 62, the gas-lift tubular 66 and the outer production tubular 240. Control lines 286 run along the upper tool assembly, radially through the ported device 80 and then longitudinally through the annulus between the outer production tubular and the gas-lift tubular.

During make up of the upper and lower tool assemblies, a central tubular joint 62*b* of the lower tool assembly is connected, here by threaded connection, to a central tubular 62*b* of the upper tool assembly. During this connection, the central tubulars 62 positioned in the upper and lower assemblies are axially and rotationally movable with respect to at least one of the gas-lift tubulars. Similarly, during subsequent connection of upper and lower gas-lift tubulars, at least one of the gas-lift tubulars is axially and rotationally movable with respect to the now-connected central tubular.

The disclosure relates to apparatus and methods for bypassing a compromised section of a wellbore when performing artificial gas-lift operations in a wellbore below the compromised section. According to aspects of the disclosure, a completion string assembly is provided for use in a gas-lift operation in a wellbore extending through a subterranean formation having a production zone, the wellbore having a compromised section incapable of effectively carrying gas-lift gas, the completion string assembly comprising: an upper string assembly positioned in the wellbore above the compromised section, an upper wellbore annulus defined between the upper string assembly and the wellbore, the upper string assembly having a central bore extending longitudinally therethrough; an upper annular packer and a lower annular packer isolating a central wellbore annulus defined along the compromised section of the wellbore; a bypass string assembly extending through the compromised section of the wellbore, the bypass string assembly having: a central tubular defining a bypass central bore extending longitudinally therethrough for allowing production fluid from the production zone mixed with gas-lift gas to flow upwards therethrough, the bypass central bore in fluid communication with the upper string assembly central bore; a gas-lift tubular surrounding the central tubular, a gas-lift annulus defined between the central tubular and the gas-lift tubular, the gas-lift annulus for allowing gas-lift gas to flow downwards therethrough, the gas-lift annulus in fluid communication with the upper wellbore annulus.

The completion string assembly may further comprise a lower string assembly positioned in the wellbore below the lower annular packer, a lower wellbore annulus defined between the lower string assembly and the wellbore, the lower string assembly having: a central bore in fluid communication with the bypass central bore; and a gas-lift injection assembly for allowing gas-lift gas to flow between the lower wellbore annulus and the central bore of the lower string assembly. The gas-lift injection assembly may be a gas-lift valve. The assembly may further comprise: a production zone annular packer isolating the lower wellbore annulus, the production zone annular packer positioned below the gas-lift injection assembly; and a production zone tubular positioned in the wellbore below the production zone annular packer, the production zone tubular having a central bore in fluid communication with the central bore of the lower string, and having ports for allowing production fluid from the production zone to flow into the central bore of the production zone tubular. The upper string assembly may further comprise: a packer for isolating a portion of the upper wellbore annulus, the packer having a gas-lift tubular extending longitudinally therethrough for allowing gas-lift gas to flow past the packer.

The assembly may further comprise a ported device for allowing gas-lift gas to flow from the upper wellbore annulus into the gas-lift annulus, the ported device positioned above the upper annular packer. The ported device may further comprise: a central bore in fluid communication with the central bore of the upper string assembly; and a plurality of gas-lift ports in fluid communication with the gas-lift annulus and the upper wellbore annulus. The ported device may further comprise: a plurality of outer production ports in fluid communication with the central bore of the upper string assembly. The plurality of outer production ports may be in fluid communication with the central wellbore annulus.

The compromised section of the wellbore may comprise a wellbore casing or liner positioned in the wellbore, the casing or liner: lacking the integrity to hold pressure against gas-lift gas; not rated to hold pressure against gas-lift gas; having one or more perforations therethrough; or crosses a wellbore junction.

The bypass string assembly may be made up of an upper tool assembly connectable to a lower tool assembly, the lower tool assembly having at least one lower central tubular joint positioned in and axially and rotationally movable with respect to at least one lower gas-lift tubular joint, the upper tool assembly having at least one upper central tubular joint positioned in and axially and rotationally movable with respect to at least one upper gas-lift tubular joint, whereby a lower and an upper central tubular joint can be rotationally connected, and then a lower and an upper gas-lift joint can be rotationally connected.

According to aspects of the disclosure a method of performing a gas-lift operation in a wellbore extending through a subterranean formation having a production zone, the wellbore having a compromised section incapable of effectively carrying gas-lift gas, is provided, the method comprising: flowing gas-lift gas through an upper wellbore annulus defined between the wellbore and an upper string assembly, the upper string assembly defining a central bore therethrough, the upper wellbore annulus isolated from the compromised section of the wellbore by an upper annular packer; flowing gas-lift gas through a bypass string assembly extending through the compromised section of the wellbore, the bypass string assembly having: a central tubular defining a central bore therethrough, the central tubular positioned in a gas-lift tubular, an annular gas-lift passageway defined between the central and gas-lift tubular, by: flowing gas-lift gas from the upper wellbore annulus into the gas-lift passageway; and flowing gas-lift gas through the gas-lift passageway and into a lower wellbore annulus defined between the bypass string assembly and the wellbore, the lower wellbore annulus isolated from the compromised section of the wellbore by a lower annular packer.

The method may further comprise: flowing production fluid from the production zone, mixed with gas-lift gas, upwards through the central bore of the bypass string assembly, past the compromised section of the wellbore, and through the central bore of the upper string assembly. The method may further comprise: flowing gas-lift gas through the lower wellbore annulus and through a gas-lift injection assembly positioned on a lower string assembly, the gas-lift injection assembly selectively allowing flow from the lower wellbore annulus to a central bore defined in the lower string assembly. The method may further comprise: mixing production fluid from the production zone with the gas-lift gas in the central bore of the lower string assembly. The method may further comprise flowing production fluid from the production zone into a lower end of the lower string assembly and past an annular production packer, the production packer isolating the production zone from the lower wellbore annulus. The method may further comprise: flowing production fluid from the production zone into a liner assembly positioned in the wellbore below the lower string assembly.

In the method, the bypass string assembly may further comprise a ported device, and further comprising flowing gas-lift gas from the upper wellbore annulus to the gas-lift passageway via gas-lift ports defined in the ported device. Hence, the method may further comprise flowing production fluid from the production zone, mixed with gas-lift gas, upwards through a central bore of the bypass string assembly and into the central bore of the upper string assembly via a central bore defined in the ported device. The method may further comprise fluidly connecting a central wellbore annulus, defined between the bypass string assembly and the compromised section of the wellbore, and the central bore of the upper string assembly with a plurality of outer production ports defined in the ported device. The method may further comprise running a wireline or coiled tubing operation in the wellbore by lowering a downhole tool on a wireline or coiled tubing through the central bore of the upper string assembly and through the central bore of the bypass string assembly. The method may further comprise maintaining wireline access into the lower string assembly without requiring an intervention operation in the wellbore.

In the method, the compromised section of the wellbore may further comprise a wellbore casing or liner positioned in the wellbore, the casing or liner: lacking the integrity to hold pressure against gas-lift gas; not rated to hold pressure against gas-lift gas; having one or more perforations therethrough; or crosses a wellbore junction.

In the method, the wellbore may further comprise a second wellbore, wherein the compromised section of the wellbore comprises a perforated casing or liner providing fluid access to the second wellbore. Hence, the method may further comprise: flowing second wellbore production fluid from a production zone adjacent the second wellbore through the perforated casing or liner and into a central wellbore annulus defined between the bypass string assembly and the wellbore in the compromised section of the wellbore. In the method, the bypass string assembly may further comprises: an outer production tubular surrounding an upper portion of the gas-lift tubular, an outer production annular passageway defined between the outer production tubular and the gas-lift tubular; and further comprising flowing second wellbore production fluid from the central wellbore annulus through the outer production annulus and into the central bore of the upper string assembly. The method may further comprise flowing second wellbore production fluid through the ported device and into the central bore of the upper string assembly. The method may further comprise mixing, in the central bore of the upper string assembly, the second wellbore production fluid with the mixed gas-lift gas and production fluid from the production zone.

The method may further comprise using a ported device having a housing connected to the central bore, gas-lift annulus and outer production annulus of the bypass string assembly, the housing defining: a central longitudinal bore in fluid communication with the central bores of the upper string assembly and the bypass string assembly; a plurality of longitudinal outer production ports fluidly connecting the central wellbore annulus and the central bore of the upper string assembly; and a plurality of longitudinal gas-lift ports fluidly connecting the annular gas-lift passageway with the upper wellbore annulus.

According to aspects of the disclosure, a bypass string assembly is presented for positioning in and extending through a compromised section of a wellbore, the bypass completion string assembly comprising: a central tubular defining a bypass central bore extending longitudinally therethrough for allowing production fluid mixed with gas-lift gas to flow upwards therethrough past the compromised section of the wellbore; and the central tubular positioned in a gas-lift tubular, a gas-lift annulus defined between the central tubular and the gas-lift tubular, the gas-lift annulus for allowing gas-lift gas to flow downwards therethrough past the compromised section of the wellbore. The assembly may further comprise: a ported device having a central longitudinal bore fluidly connected to the bypass central bore and an exterior of the bypass string assembly, and having a plurality of gas-lift ports fluidly connected to the gas-lift annulus and the exterior of the bypass string assembly. The gas-lift ports may be fluidly connected to the exterior of the assembly via radial gas-lift passageways extending through a circumferential wall of the bypass string assembly. The assembly may further comprise an annular packer assembly surrounding a circumference of gas-lift tubular. The assembly may further comprise: an outer production tubular, the gas-lift tubular positioned in the outer production tubular, the outer production tubular extending through the annular packer, an outer production annulus defined between the outer production tubular and the gas-lift tubular, and the ported device having a plurality of outer production ports fluidly connecting to the outer production annulus and the exterior of the bypass string assembly. The plurality of gas-lift ports may fluidly connect to the exterior of the bypass string assembly through a corresponding plurality of radial parts; and wherein the plurality of outer production ports fluidly connect to the exterior of the bypass string assembly longitudinally.

The disclosure is provided in support of the methods claimed or which may be later claimed. Specifically, this support is provided to meet the technical, procedural, or substantive requirements of certain examining offices. It is expressly understood that the portions of the methods disclosed and claimed can be performed in any order, unless otherwise specified or necessary, that each portion of the method can be repeated, performed in orders other than those presented, that additional actions can be performed between the enumerated actions, and that, unless stated or claimed otherwise, actions can be omitted or moved. Those of skill in the art will recognize the various possible combinations and permutations of actions performable in the methods disclosed herein without an explicit listing of every possible such combination or permutation. It is explicitly disclosed and understood that the actions disclosed herein can be performed in various orders (xyz, xzy, yxz, yzx, etc.) without writing them all out.

The embodiments disclosed above are illustrative only, as the present disclosure may be modified and practiced in different but equivalent manners apparent to those skilled in the art having the benefit of the teachings herein. It is, therefore, evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. Furthermore, no limitations are intended to the details of construction, composition, design, or steps herein shown, other than as described in the claims.

It is claimed:

1. A completion string assembly for use in a gas-lift operation in a wellbore extending through a subterranean formation having a production zone, the wellbore having a damaged section incapable of effectively carrying gas-lift gas, the completion string assembly comprising:

an upper string assembly positioned in the wellbore above the damaged section, an upper wellbore annulus defined between the upper string assembly and the wellbore, the upper string assembly having a central bore extending longitudinally therethrough;

a bypass string assembly extending through the damaged section of the wellbore, the bypass string assembly having:

a central tubular defining a bypass central bore extending longitudinally therethrough for allowing production fluid from the production zone mixed with gas-lift gas to flow upwards therethrough, the bypass central bore in fluid communication with the upper string assembly central bore;

a gas-lift tubular surrounding the central tubular, a gas-lift annulus defined between the central tubular and the gas-lift tubular and a central wellbore annulus defined between the gas-lift tubular and the wellbore, the gas-lift annulus for allowing gas-lift gas to flow downwards therethrough to mix with production fluid below the bypass string assembly, the gas-lift annulus in fluid communication with the upper wellbore annulus;

an upper annular packer sealing against fluid flow between the central wellbore annulus and the upper wellbore annulus; and a lower annular packer sealing against fluid flow between the central wellbore annulus and a lower wellbore annulus, the central wellbore annulus fluidly isolated along the damaged section of the wellbore by the upper and lower annular packers; and a lower string assembly positioned in the wellbore below the lower annular packer and attached to the gas-lift tubular, the lower wellbore annulus defined between the lower string assembly and the wellbore, the lower string assembly having a central bore in fluid communication with the bypass central bore.

2. The assembly of claim 1, further comprising a gas-lift injection assembly for allowing gas-lift gas to flow between the lower wellbore annulus and the central bore of the lower string assembly.

3. The assembly of claim 2, further comprising:

a production zone annular packer isolating the lower wellbore annulus, the production zone annular packer positioned below the gas-lift injection assembly; and a production zone tubular positioned in the wellbore below the production zone annular packer, the production zone tubular having a central bore in fluid communication with the central bore of the lower string, and having ports for allowing production fluid from the production zone to flow into the central bore of the production zone tubular.

4. The assembly of claim 1, further comprising a ported device for allowing gas-lift gas to flow from the upper wellbore annulus into the gas-lift annulus, the ported device positioned above the upper annular packer.

5. A method of performing a gas-lift operation in a first wellbore extending through a subterranean formation having a production zone, the first wellbore having a compromised section comprising a perforated casing or liner providing fluid access to a second wellbore extending from the first wellbore and therefore incapable of effectively carrying gas-lift gas, the method comprising:

flowing gas-lift gas through an upper wellbore annulus defined between the first wellbore and an upper string assembly, the upper string assembly defining a central bore therethrough, the upper wellbore annulus isolated from the compromised section of the first wellbore by an upper annular packer;

flowing gas-lift gas through a bypass string assembly extending through the compromised section of the wellbore, the bypass string assembly having: a central tubular defining a central bore therethrough, the central tubular positioned in a gas-lift tubular, an annular gas-lift passageway defined between the central and gas-lift tubular, by: flowing gas-lift gas from the upper wellbore annulus into the gas-lift passageway; and flowing gas-lift gas from through the gas-lift passageway and into a lower wellbore annulus defined between the bypass string assembly and the first wellbore, the lower wellbore annulus isolated from the compromised section of the first wellbore by a lower annular packer; and flowing production fluid from the production zone, mixed with gas-lift gas, upwards through the central bore of the bypass string assembly, past the compromised section of the first wellbore, and through the central bore of the upper string assembly;

flowing second wellbore production fluid from a production zone adjacent the second wellbore through the perforated casing or liner and into a central wellbore annulus defined between the bypass string assembly and the wellbore in the compromised section of the first wellbore; and wherein the bypass string assembly further comprises an outer production tubular surrounding an upper portion of the gas-lift tubular, an outer production annular passageway defined between the outer production tubular and the gas-lift tubular; and further comprising flowing second wellbore production fluid from the central wellbore annulus through the outer production annulus and into the central bore of the upper string assembly.

6. The method of claim 5, further comprising: flowing gas-lift gas from the lower wellbore annulus through a gas-lift injection assembly positioned on the lower string assembly, the gas-lift injection assembly selectively allowing flow from the lower wellbore annulus to a central bore defined in the lower string assembly.

7. The method of claim 6, further comprising: mixing production fluid from the production zone with the gas-lift gas in the central bore of the lower string assembly.

8. The method of claim 7, further comprising flowing production fluid from the production zone into a lower end of the lower string assembly and past an annular production packer, the production packer isolating the production zone from the lower wellbore annulus.

9. The method of claim 6, further comprising running a wireline or coiled tubing operation in the wellbore by lowering a downhole tool on a wireline or coiled tubing through the central bore of the upper string assembly and through the central bore of the bypass string assembly.

10. The method of claim 5, the bypass string assembly further comprising a ported device, and further comprising flowing gas-lift gas from the upper wellbore annulus to the gas-lift passageway via gas-lift ports defined in the ported device.

11. The method of claim 10, further comprising flowing production fluid from the production zone, mixed with gas-lift gas, upwards through a central bore of the bypass string assembly and into the central bore of the upper string assembly via a central bore defined in the ported device.

12. The method of claim 11, further comprising fluidly connecting a central wellbore annulus, defined between the bypass string assembly and the compromised section of the wellbore, and the central bore of the upper string assembly with a plurality of outer production ports defined in the ported device.

13. The method of claim 5, further comprising a ported device having a housing connected to the central bore, gas-lift annulus and outer production annulus of the bypass string assembly, the housing defining:

a central longitudinal bore in fluid communication with the central bores of the upper string assembly and the bypass string assembly;

a plurality of longitudinal outer production ports fluidly connecting the central wellbore annulus and the central bore of the upper string assembly; and a plurality of longitudinal gas-lift ports fluidly connecting the annular gas-lift passageway with the upper wellbore annulus.

14. A gas-lift bypass system for a multilateral wellbore system having an upper wellbore extending from the surface, a main wellbore extending from the upper wellbore, and a secondary wellbore extending from the upper wellbore, a wellbore junction defined between the main wellbore and the secondary wellbore, the gas-lift bypass system comprising:

a perforated tubular extending across the wellbore junction from the upper wellbore to the secondary wellbore, the perforated tubular annularly sealed against the upper wellbore and the secondary wellbore;

an upper string assembly positioned in the upper wellbore, an upper wellbore annulus defined between the upper string assembly and the upper wellbore, the upper string assembly having a central bore extending longitudinally therethrough;

a central tubular defining a bypass central bore extending longitudinally therethrough, the bypass central bore in fluid communication with the upper string assembly central bore, the central tubular for flowing production fluid mixed with gas-lift gas upwards therethrough from the secondary wellbore, through the bypass central bore, past the wellbore junction, and into the upper string assembly central bore; and the central tubular positioned in a gas-lift tubular, a gas-lift annulus defined between the central tubular and the gas-lift tubular, the gas-lift annulus in fluid communication with the upper wellbore annulus and a secondary wellbore annulus, the gas-lift annulus for flowing gas-lift gas downwards therethrough past the wellbore junction;

an upper portion of the gas-lift tubular positioned in a production tubular, a production annular passageway defined between the production tubular and the gas-lift tubular, the production annular passageway in fluid communication with the central bore of the upper string assembly and a perforated tubular annulus defined between the perforated tubular and the gas-lift tubular; and a lower string assembly positioned in the secondary wellbore, the secondary wellbore annulus defined between the lower string assembly and the secondary wellbore, the lower string assembly having a central bore in fluid communication with the bypass central bore.

* * * * *